US005174744A

United States Patent [19]

Singh

[11] Patent Number: 5,174,744

[45] Date of Patent: Dec. 29, 1992

[54] INDUSTRIAL BURNER WITH LOW $NO_x$ AND CO EMISSIONS

[75] Inventor: Shyam N. Singh, Rockford, Ill.

[73] Assignee: Gas Research Institute, Chicago, Ill.

[21] Appl. No.: 786,523

[22] Filed: Nov. 1, 1991

[51] Int. Cl.[5] ..... F23D 14/12

[52] U.S. Cl. ..... 431/347; 431/326; 126/92 AC; 126/91 R

[58] Field of Search ..... 431/326, 327, 328, 100, 431/347, 329; 126/92 AC, 92 C, 91 R

[56] References Cited

U.S. PATENT DOCUMENTS

| | | | |
|---|---|---|---|
| 3,403,965 | 10/1968 | Dreisziger | 431/347 |
| 3,806,307 | 4/1974 | Ware | 431/353 |
| 4,284,402 | 8/1981 | Sheets et al. | 431/347 X |
| 4,437,833 | 3/1984 | Mertz | 431/329 |
| 4,597,734 | 7/1986 | McCausland et al. | 431/328 |
| 4,616,994 | 10/1986 | Tomlinson | 431/347 |
| 4,631,023 | 12/1986 | Courrege | 431/329 |
| 4,889,481 | 12/1989 | Morris et al. | 431/328 |
| 5,057,007 | 10/1991 | Andringa et al. | 431/329 X |

*Primary Examiner*—Larry Jones
*Attorney, Agent, or Firm*—Leydig, Voit & Mayer

[57] ABSTRACT

A block-like curtain of reticulated ceramic foam is spaced forwardly of the burner nozzle of an industrial burner and, when heated by the flame of the burner, oxidizes unburned CO into $CO_2$ to reduce the emissions of CO. By virtue of the curtain reducing the CO emissions, the burner may operate with a slower, longer and lower temperature flame so as to reduce $NO_x$ emissions. The curtain may be adjusted toward and away from the burner nozzle in order to correlate the position of the curtain with the length of the flame.

2 Claims, 1 Drawing Sheet

INDUSTRIAL BURNER WITH LOW $NO_x$ AND CO EMISSIONS

BACKGROUND OF THE INVENTION

This invention relates to an industrial burner of the type in which a mixture of gaseous fuel and combustion air is ignited at the face of a nozzle to produce a flame for heating air, for drying material or for various other industrial purposes. Such a burner may be of a nozzle mix design or a premix design. In a nozzle mix design, fuel and combustion air are first mixed at the face of the nozzle and then are ignited to produce a stable flame. In a premix design, the fuel and combustion air are well mixed before being discharged through the nozzle for ignition at the face thereof.

Environmental requirements dictate that such burners operate with significantly reduced emissions of carbon monoxide (CO) and nitrogen oxides ($NO_x$). Due to variations in the combustion process and flame geometry, the formation of CO and $NO_x$ changes as a function of fuel input to the burner. When a burner is fired at a low level, formation of $NO_x$ is comparatively insignificant while the formation of CO is relatively high as a result of the quenching effect of the incoming combustion air. At higher firing levels, CO emissions are reduced but $NO_x$ emissions increase.

SUMMARY OF THE INVENTION

The general aim of the present invention is to provide a new and improved burner which significantly reduces the emissions of both CO and $NO_x$ at various firing levels.

A more detailed object of the invention is to achieve the foregoing by providing a burner in which a curtain of reticulated ceramic foam is uniquely located in forwardly spaced relation from the burner nozzle to be impinged by the flame. By virtue of the curtain, the mixing rate of the fuel and combustion air may be slowed to elongate the flame and reduce the formation of $NO_x$. While this increases the formation of CO, the unburned CO passes through the hot surfaces of the reticulated curtain and is oxidized into $CO_2$ by the heat and by the oxygen in the surrounding atmosphere.

Still another object of the invention is to provide a reticulated curtain of the foregoing type which may be selectively adjusted toward and away from the burner nozzle in order to correlate the position of the curtain with the length of the flame.

These and other objects and advantages of the invention will become more apparent from the following detailed description when taken in conjunction with the accompanying drawings.

DETAILED DESCRIPTION OF THE PREFERRED EMBODIMENT

Figure 1:
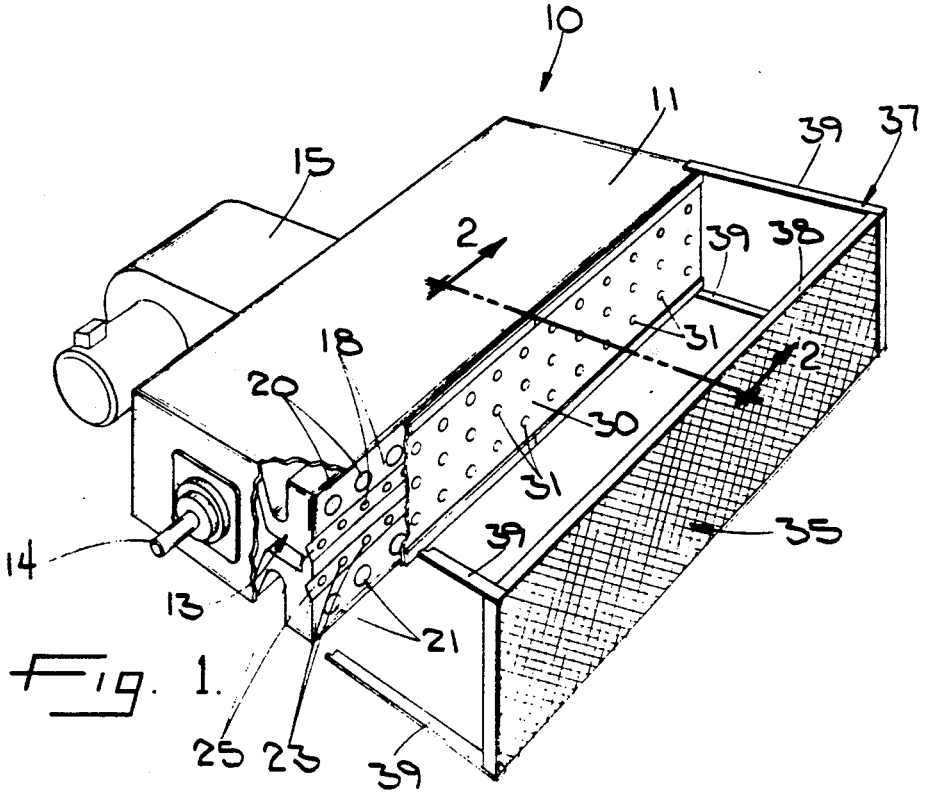
FIG. 1 is a simplified perspective view of a new and improved industrial burner incorporating the unique features of the present invention.

For purposes of illustration, the invention has been shown in the drawings as embodied in an industrial burner 10 adapted to be used in a burner or adapted to be positioned in or adjacent to a stream of air or other gas under pressure for the purpose of heating the stream. While the principles of the invention are applicable to various types of burners, the particular burner which has been illustrated is generally similar to that disclosed in Spielman U.S. Pat. No. 4,403,947. Many components of the burner are of well known construction and reference may be made to the aforementioned patent for a detailed disclosure of such components.

Briefly, the burner comprises a box-like housing 11 made of sheet metal and having a generally rectangular cross-section. Disposed within the housing is an elongated cast iron burner nozzle 13 which extends along the front of the housing. Gaseous fuel for the burner is supplied through a gas line 14 leading into one side of the housing. A motor-driven blower 15 is located at the rear of the housing and delivers pressurized air into the housing for mixture with the fuel in order to support combustion thereof.

Natural gas or other fuel under pressure (e.g., propane or butane) is supplied under pressure through the line 14 to a fuel chamber 17 (FIG. 2) in the nozzle 13. Fuel from the chamber is discharged to the forward face of the nozzle by means of upper and lower rows of laterally spaced fuel passages 18 and 19 communicating with the fuel chamber and leading to the forward face of the nozzle. The fuel passages of the upper row are inclined upwardly while the passages of the lower row are inclined downwardly.

Combustion air from the blower 15 is directed through upper and lower rows of laterally spaced main combustion air passages 20 and 21 (FIG. 2) formed horizontally through the nozzle 13 and leading to the forward face thereof. Downwardly inclined stabilizing air passages 22 lead from the upper main air passages 20 toward the discharge ends of the upper fuel passages 18 while upwardly inclined stabilizing air passages 23 lead from the lower main air passages 21 toward the discharge ends of the lower fuel passages 19. Upper and lower substantially V-shaped grooves 25 are formed in the front face of the nozzle in the vicinity of the discharge ends of the fuel passages and the auxiliary air passages.

Figure 2:
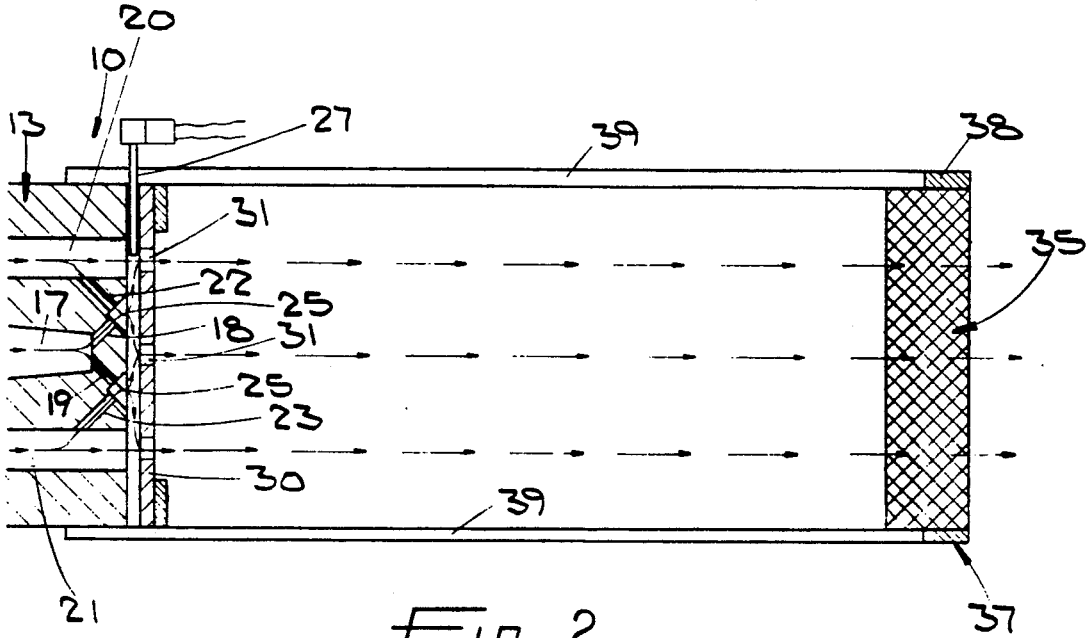
FIG. 2 is an enlarged fragmentary cross-section taken substantially along the line 2—2 of FIG. 1.

Fuel discharged through the passages 18 and 19 is initially ignited by a spark from an electronic ignition device 27 which has been shown schematically in FIG. 2. The jets of fuel issuing from the passages 18 and 19 are picked up by and are mixed with the air flowing through the main combustion air passages 20 and 21 so as to form a main combustible fuel/air mixture for creating a flame. At the same time, the jets of air flowing through the air stabilizing passages 22 and 23 attract a portion of the fuel issuing from the fuel passages 18 and 19 to create a constant ignition source for the main mixture.

The flame exiting from the nozzle 13 passes through a plate 30 with a series of holes 31 and proceeds downstream from the plate. A combustion chamber (not shown) in the form of a ceramic sleeve or stainless steel plates may be located downstream of the plate 30. The aforementioned Spielman patent discloses combustion chambers of the type which may be used with the present burner 10.

In order to reduce atmospheric pollution, it is desirable to keep $NO_x$ and CO emissions from the hot gaseous stream as low as possible. According to the present invention, $NO_x$ and CO emissions are reduced by positioning a curtain 35 made of reticulated ceramic foam in spaced relation with the front of the nozzle 13.

Herein, the curtain 13 is in the form of a generally rectangular block having substantially the same rectangular dimensions as the burner nozzle 13. The block-like curtain is supported in a holder 37 which herein includes a rectangular front frame 38 within which the curtain is secured. The holder 37 also includes four struts 39 connected to the corners of the frame 38 and extending rearwardly to the housing 11.

The specific reticulated ceramic foam which is used to form the curtain 35 preferably is a high temperature material sold by High Tech Ceramics of Alfred, New York and designated as silicon carbide foam. The foam or similar high temperature material may vary in thickness from about ¼" to about 2" and its porosity may range between 10 pores per inch and 30 pores per inch. Highly porous reticulated ceramic offers reduced air/-gas mixture pressure. Its irregular internal structure creates turbulence when combusting gases pass through the ceramic. This in turn enhances the convective heat transfer which further raises the thermal radiation level. Further, lighter thermal mass results in rapid heating and cooling of the burner surface.

As a result of the ceramic foam curtain 35, the mixing rate of the gaseous fuel and the combustion air may be slowed at the nozzle 13 to produce a longer and slower flame and thereby keep the temperature of the flame low. By slowing the combustion and maintaining the flame temperature below a critical level (i.e., below 2800 degrees F.), the emissions of $NO_x$ are held to a low level. While the low temperature flame reduces $NO_x$ emissions, CO emissions increase because of the quenching effect on the hot gaseous stream caused by the combustion air flowing through the passages 20 and 21. The unburned CO, however, passes through the curtain 35 and impinges against the multiple hot surfaces thereof. This results in the CO being oxidized into $CO_2$ by the oxygen in the surrounding atmosphere so as to reduce the emissions of CO from the burner 10.

The ceramic foam curtain 35 has a very high surface area per unit volume and thus transfers or releases heat quickly to produce a cooler gas temperature. It is believed that this may effect further reduction in the emissions of $NO_x$.

The curtain 35 preferably may be selectively adjusted toward and away from the front face of the nozzle 13 to match the length of the flame from the nozzle. Thus, the curtain may be moved away from the nozzle for longer flames and toward the nozzle for shorter flames. In the simplest form of adjustment, the struts 39 may be slid back or forth on the housing 11 and anchored in a selected position in order to locate the frame 37 and the curtain 35 a predetermined distance in front of the nozzle. Alternatively, each strut may be made of two pieces which may be selectively retracted or extended relative to one another.

I claim:

1. A burner having a housing and having a nozzle supported by said housing, said nozzle having a forward face, passages in said nozzle for discharging gaseous fuel at the forward face of the nozzle, separate passages in said nozzle for discharging combustion air at the forward face of the nozzle, said fuel and said combustion air forming a combustible fuel/air mixture discharged forwardly from said nozzle, means for igniting said mixture to produce a flame which shoots forwardly from said nozzle, a curtain of reticulated ceramic foam located in forwardly spaced relation from said nozzle, a holder supporting said curtain, said flame impinging upon and heating said curtain with the hated curtain coacting with the surrounding atmosphere to oxidize unburned carbon monoxide in said flame and to convert the unburned carbon monoxide into carbon dioxide, and means connecting said holder to said housing and permitting selective adjustment of said holder and said curtain toward and away from said nozzle thereby to enable the forward spacing of said curtain from said nozzle to be selectively changed in accordance with the length of the flame.

2. A burner as defined in claim 1 in which the forward face of said nozzle is generally rectangular and is of predetermined rectangular dimensions, said curtain being generally rectangular and having approximately the same rectangular dimensions as the forward face of said nozzle.

* * * * *